United States Patent [19]

Carlsson

[11] Patent Number: 4,544,104

[45] Date of Patent: Oct. 1, 1985

[54] WOOD CHIPPER

[75] Inventor: Jan E. K. Carlsson, Vittaryd, Sweden

[73] Assignee: KMW ERJO AB, Lagan, Sweden

[21] Appl. No.: 562,455

[22] Filed: Dec. 16, 1983

[51] Int. Cl.[4] ..... B02C 23/00

[52] U.S. Cl. ..... 241/57; 241/73; 241/101.7; 241/285 B

[58] Field of Search ..... 144/22, 242 R; 241/57, 241/101.7, 92, 285 R, 285 A, 73, 285 B, 79

[56] References Cited

U.S. PATENT DOCUMENTS

| | | | |
|---|---|---|---|
| 1,928,887 | 10/1933 | Gredell | 241/73 |
| 3,813,045 | 5/1974 | Greiffenstern | 241/73 X |
| 4,062,498 | 12/1977 | Szepaniak | 241/101.7 |
| 4,073,444 | 2/1978 | Pav | 241/285 B X |

FOREIGN PATENT DOCUMENTS

| | | |
|---|---|---|
| 163710 | 6/1958 | Sweden . |
| 80031859 | 4/1980 | Sweden . |

*Primary Examiner*—Mark Rosenbaum

*Attorney, Agent, or Firm*—Bell, Seltzer, Part & Gibson

[57] ABSTRACT

In order to enable the setting of the inlet funnel of a wood chipper to different positions for adaptation to prevailing operating conditions including the type of material to be chipped, it is proposed in accordance with the invention that cooperating bearing means be arranged on the chipper rotor housing of the wood chipper and on the frame supporting the chipper rotor housing so that the chipper rotor housing and the inlet funnel are pivotal around the axis of rotation of the chipper rotor.

17 Claims, 9 Drawing Figures

WOOD CHIPPER

FIELD OF THE INVENTION

The present invention relates to improvements in a wood chipper comprising a chipper rotor housing supported by a frame and a chipper rotor rotatably journalled therein, said chipper rotor housing having inlet means for feeding material intended for chipping into the chipper rotor and outlet means for discharging wood chips produced by the chipper rotor.

BACKGROUND OF THE INVENTION AND PRIOR ART

Swedish patent application No. 7512817-3 describes a mobile forest cut machine which includes a feeder device that is pivotal between a horizontal operating position and a substantially vertical operating position. However, the construction is such that the feeder device is incapable of being altered during actual operation and that pivoting cannot be performed unless the outlet pipe and the ejector hood are pivoted to an equivalent extent. Moreover, the forest cut machine is useful only for forest material that can be fed in with a regular direction, i.e. the pieces of material such as branches, limbs and trunks are substantially directed regularly in the direction of feeding.

Swedish patent application No. 8003185-9 describes a mobile chipper which is provided with a special device comprising a cutter drum with cam-like cut strips which cooperate with a complementary counter member in order to disintegrate branches and other parts of trees which turn across the direction of feeding after the actual chipping has been performed in a chipper rotor. However, such a device requires more space for the chipper as well as extra bearings and drive mechanisms for the special device. Swedish patent specification No. 163710 describes a wood chipper with a chipper rotor housing which is stationary with respect to a chipper rotor rotatably journalled therein.

SUMMARY OF THE INVENTION

An object of the invention is to obtain a wood chipper with an inlet opening which can be rapidly altered to varying positions in accordance with prevailing operating conditions and the type of material to be chipped whereby this alteration is possible to be performed even during operation. This alteration in operation may also be performed while the chipper is being moved.

Another object of the invention is to obtain a wood chipper in combination with a fan housing, the outlet pipe and ejector hood of which can be maintained unaltered independently of a pivot movement and alteration in position of the inlet opening of the wood chipper.

A further object of the invention is to obtain a wood chipper which can easily be adapted to chipping a plurality of different types of forest raw materials, including industrial and forest waste which frequently contain parts that are present in a mixture in a disordered manner.

According to the invention the chipper rotor housing and the frame comprise cooperating bearing means, the chipper rotor housing being by means of said bearing means pivotally arranged on the frame for pivoting around the axis of rotation of the chipper rotor and setting of said inlet means in different operating positions for adaptation to different operating conditions.

In accordance with a preferred embodiment of the invention the wood chipper housing is combined with a fan housing which is stationary in relation to the chipper rotor housing and which has an outlet pipe with an ejector hood whereby the outlet pipe and ejector hood remain in the desired set position during rotation or pivot movement of the chipper rotor housing.

In accordance with another preferred embodiment of the invention the wood chipper comprises a separating device arranged in the chipper rotor housing. This separating device is arranged to permit pieces of material of the desired maximum size and less to pass therethrough and oversized pieces of material to be returned to a counter member at the inlet opening and collaborating with the chipper rotor. The separating device can be advantageously designed as a cassette-like unit which is rapidly and simply inserted into position in the chipper rotor housing and which is replaceable by an externally identical cassette providing a different maximum size of the discharged chips. Thus, the wood chipper can easily be adapted to prevailing specific operating conditions in that the right cassette will be determined by simple tests with different cassettes.

The invention will be described in more detail in the following with reference to the accompanying drawings.

DESCRIPTION OF THE ILLUSTRATED EMBODIMENTS

Figure 1:
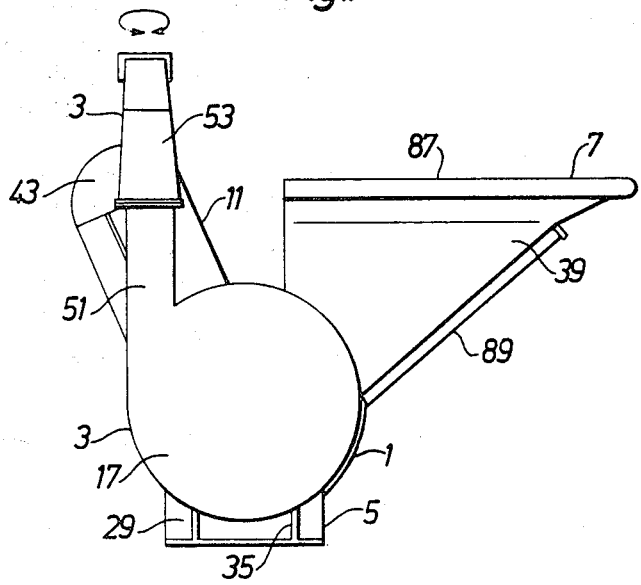
FIGS. 1 and 2 are elevation views from the fan side of a wood chipper in accordance with the invention wherein the inlet funnel is shown in its two operating end positions.
Figure 2:
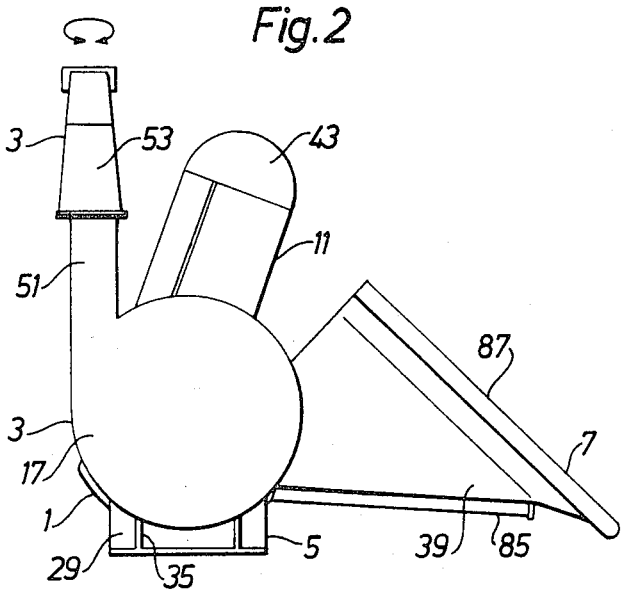
Figure 3:
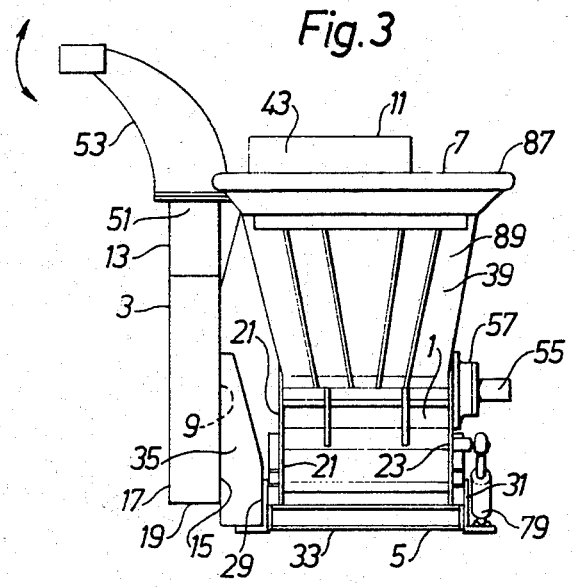
FIG. 3 is a front elevation view of the wood chipper as shown in FIG. 1.

With reference to FIGS. 1 to 6 there is shown a wood chipper which includes a chipper rotor housing 1, a fan housing 3 mounted at one vertical side thereof, and a frame 5 for supporting both the chipper rotor housing 1 and the fan housing 3. The chipper rotor housing and fan housing are each provided with an inlet means 7 and 9, respectively, and an outlet means 11 and 13, respectively, the outlet means 11 of the chipper rotor housing being connected to the inlet means 9 of the fan housing.

The fan housing 3 further includes an inner gable 15, an outer gable 17, and a fan casing 19 connecting said gables and enclosing a rotatable fan wheel. In the same way the chipper rotor housing 1 comprises an inner gable 21, an outer gable 23, and a plurality of distance elements connecting said gables 21, 23.

The frame 5 comprises two opposite parallel gable elements 29, 31 and a distance element 33 rigidly connected thereto whereby the frame 5 supports the fan housing 3 via a rigid connection consisting of two upright brackets 35 arranged at an angle to each other. The brackets define between themselves a space and are welded in position to the inner gable of the fan housing 3 and the opposite gable element 29 of the frame 5.

In the embodiment shown the inlet means 7 of the chipper rotor housing 1 includes a rectangular inlet opening 37 and an inlet funnel 39 which is connected to said inlet opening 37 for feeding material to be chipped into the chipper rotor housing 1. The inlet funnel widens outwardly. The outlet means 11 of the chipper rotor housing includes a rectangular outlet opening 41 arranged at a distance from the inlet opening 37 whereby the outlet opening 41 is substantially facing upwards, while the inlet opening 37 is aligned substantially to the side or obliquely upwards depending on the set operating position. The outlet means 11 further includes a tubular outlet connection 43 which is bent through 180° and supported by the chipper rotor housing 1. The connection 43 has an outlet end 45 for communicating with the fan housing 3.

The inlet means 9 of the fan housing 3 includes an inlet opening 47 arranged at the centre of the inner gable 15, said outlet end 45 of the outlet connection 43 being aligned with the inlet opening 47. The outlet means 13 of the fan housing includes an upwardly directed outlet opening 49 in the fan casing 19 and a substantially vertical outlet pipe 51 with an adjustable, curved ejector hood 53 for setting the direction of ejection. The ejector hood 53 may suitably be turnable, e.g. 360°, and foldable in the vertical plane.

Figure 7:
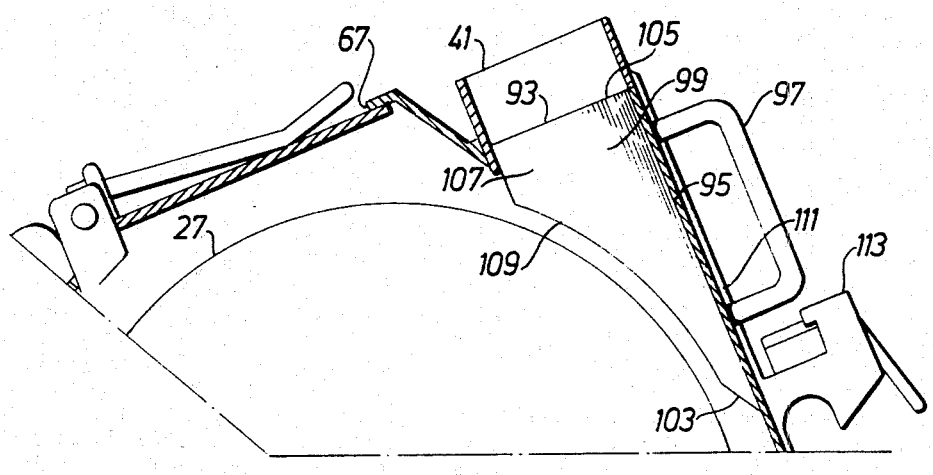
FIG. 7 is an enlarged cross section of the upper portion of the chipper rotor housing in accordance with FIG. 4.

The chipper rotor 27 having a drum shape is rotatably journalled in the chipper rotor housing 1 whereby its horizontal rotation axis 55 or its axle spindles are journalled in bearing means 57 which are attached to the gables of the chipper rotor housing. The chipper rotor is driven in the direction shown by the arrow (FIG. 4) by means of a suitable power transmission device via e.g. a pulley on the chipper rotor axis. In the embodiment shown the axis of the chipper rotor is extended and supports at its extended end a fan wheel (not shown) which rotates in the fan housing and is thereby driven simultaneously with the chipper rotor. The chipper rotor 27 is provided with a plurality of peripherically arranged chipper knives 59 (omitted in FIG. 7) distributed evenly around the circumference of the chipper rotor. The chipper knives 59 are arranged to cooperate during operation with a counter member 61 mounted in the rotor housing, said counter member being parallel to the chipper knives and adjustably and reversably attached to a bed plate 63 which is in turn attached to the rotor housing inside the lower edge of the inlet opening. As will be seen from FIG. 4 the chipper knives 59 will during the rotation of the chipper rotor pass-by the inlet opening 37 and thereby entrain supplied material in the direction to the counter member 61 where the material is gradually disintegrated to chips. Further, there are bottom plates 65 mounted below the chipper rotor, said bottom plates being spaced for sucking in secondary air through the opening between the plates. In order to make it possible for the chipper knives 59 to be easily changed the chipper rotor housing is provided with an upper recloseable aperture 67.

The chipper rotor housing 1 is rotatably or pivotally journalled at the frame 5 in such a manner that the axis of pivoting coincides with the rotation axis 55 of the chipper rotor whereby the chipper rotor housing 1 and the frame 5 are provided with specially designed, cooperating bearing means. In the embodiment shown the surfaces facing each other of the gable elements 29, 31 of the frame are each provided with a pair of arc-shaped support means in the form of support rails 71, 73 having radii whose centre is located in the rotation axis 55 of the chipper rotor. The support rails 71, 73 of each pair are arranged at a predetermined distance from each other in order to define between themselves an arc-shaped interspace 75 which faces the corresponding interspace in the other pair of support rails. The lower support rail 73 of each pair is suitably somewhat wider than the upper support rail 71. Moreover, the surfaces of the support rails facing each other in each pair are provided with shallow recesses or grooves (not shown) located next to each gable element, said grooves being connected to one or more lubricating nipples mounted in the gable elements for the introduction of lubricating grease into each groove. The chipper rotor housing 1 is provided at the lower part of each gable 21, 23 with a guide means in the form of an arc-shaped guide rail 77 which also has a radius whose centre is located in the rotation axis 55 of the chipper rotor. In addition, the guide rails 77 have the same radius as the interspace 75 defined by the frame pair of support rails 71, 73. The guide rails 77 are thereby arranged to be freely, i.e. with a small clearance, received in said interspaces in order to be guided by the support rails 71, 73 when the chipper rotor housing is pivoted in relation to the frame 5. The pivoting of the chipper rotor housing is achieved with the aid of a suitable power transmission means. In the embodiment shown this consists of a double-acting hydraulic cylinder 79 one end of which is attached to the outer gable element 31 of the frame whereas the other end is attached to the outer gable 23 of the chipper rotor housing at a suitable distance from the axis of pivoting (rotation axis 55). The cylinder is infinitely adjustable so that even any desired intermediate position whatsoever for the inlet funnel 39 can be set. In the embodiment shown the inlet funnel can be pivoted within an angle range of about 43°, (3° below and 40° above the horizontal plane) but this angle range of pivoting may of course be varied, e.g. up to about 100° (10° below and 90° above the horizontal plane).

The outlet connection 43 extending from the chipper rotor housing communicates with the fan housing via its outlet end 45 which is aligned with the central inlet opening 47 in the inner gable of the fan housing as previously described. The outlet end 45 has a flat orifice edge 81 (FIG. 6) which can have a radial flange 83 and which is parallel to the inner gable of the fan housing. The orifice edge 81 and its flange 83 enclose the central inlet opening 47 of the fan housing and is free from a mechanical connection with the fan housing. Suitably, there is a small gap between the orifice edge and the gable of the fan housing, however, the orifice edge can also be arranged for sliding contact with the gable 15. In the preferred embodiment shown the outlet end 45 includes a U-shaped plate which is attached to the inner gable 21 of the chipper rotor housing by its edge 85 facing away from the orifice edge.

It will be clear from the above that the outlet connection forms a moveable unit together with the chipper rotor housing and that this unit is rotatable or pivotal around said axis of pivoting, i.e. the rotation axis 55 of the chipper rotor, and in relation to the fan housing 3 in that said orifice edge 81 is not attached to the fan housing by any rigid or torsionally stiff joint.

The inlet funnel 39 is attached to the chipper rotor housing and thereby forms part of said pivotal unit. The inlet funnel has an outer edge 87 which in the upper rotational end position is located horizontally and in the lower rotational end position is located in an oblique plane so that the inlet funnel front side 89 is located substantially horizontally or with some inclination outwards or inwards.

The wood chipper shown also includes a specially designed separating device 91 which is mounted for separating too large pieces of material which have not been chipped to the desired size so that clogging of the feed connection or the fan housing by such oversized pieces is prevented and so that a homogeneous product is obtained with the desired maximum size of the chips.

Figure 8:
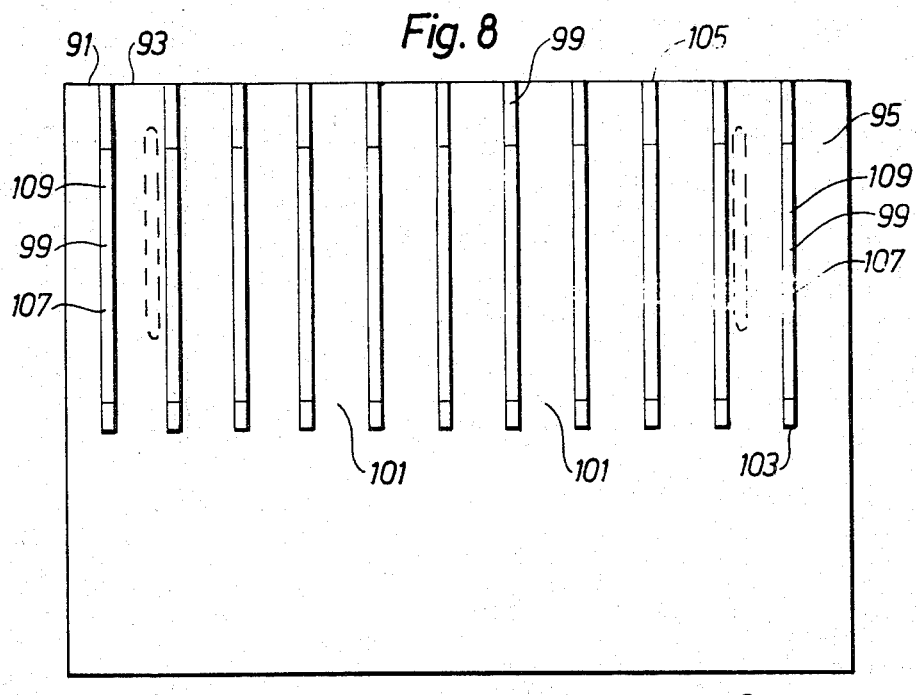
FIGS. 8 and 9 are a top view and an end view, respectively, of a cassette-like separating device which is used in the wood chipper in accordance with FIGS. 1 to 4.
Figure 9:
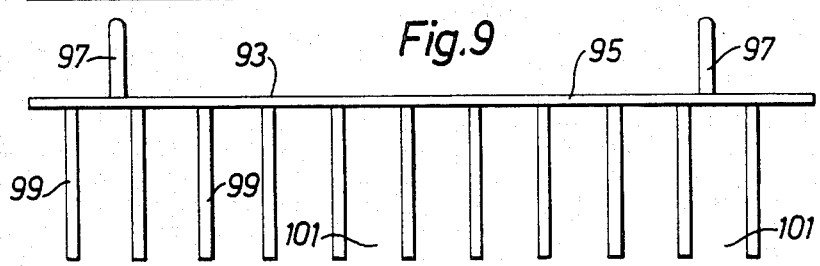

In the embodiment shown such a separating device 91 is arranged in the chipper rotor housing before the outlet opening 41 thereof. The separating device is shown in more detail in FIGS. 7 to 9 in the form of a unit or cassette 93 which is insertable into the chipper rotor housing, and includes a supporting plate 95 with two handles 97 arranged on the outer surface thereof. The supporting plate 95, which may be flat as shown or curved, supports on its inner surface a plurality of oblong, parallel, uniform ribs 99, which have opposite, parallel surfaces being perpendicular to the supporting plate 17. The ribs are linear and arranged at predetermined, equal or substantially equal distances from each other to form spaces 101 therebetween such that chips of the desired maximum size and less are allowed to pass through the spaces 101 in the longitudinal direction of the ribs 99. The spaces 101 are open at both the upstream end 103 and the downstream end 105 of the cassette, seen in the direction of the flow of chips. The spaces are also open at the inside of the cassette facing the chipper rotor whereby said downstream end connects to the outlet opening 41 of the chipper rotor housing. Each rib 99 includes an upstream located portion 107 which has an arc-shaped edge 109, facing the chipper rotor, of predetermined length and with a somewhat larger radius than the chipper rotor 27, said larger radius having its centre in or substantially in the axis of rotation of the chipper rotor. Thus, the arc-shaped edges 109 of the ribs will be arranged at a predetermined distance from the cylindrical surface of the chipper rotor so that too large, i.e. usually too long, pieces of material are allowed to by-pass the cassette in order to be returned to the chipping site at the counter member 61 whereas chipped pieces of the desired maximum size and less are allowed to pass between the ribs 99 and further out through the outlet opening 41.

Figure 4:
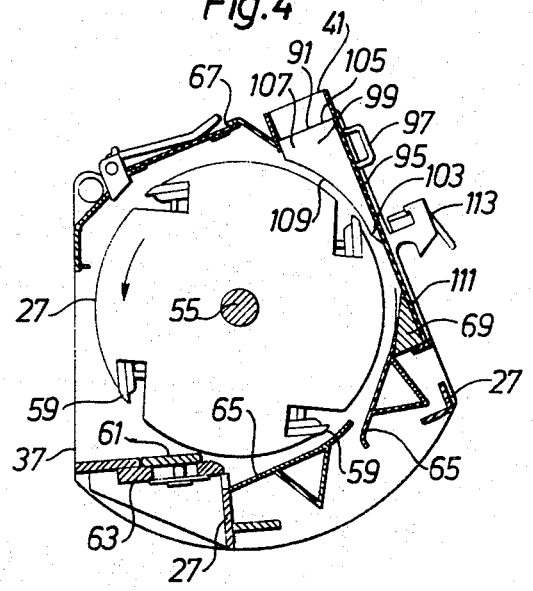
FIG. 4 is a cross section of the chipper rotor housing seen in the position it assumes when the wood chipper is set for horizontal supply of material in accordance with FIG. 2.
Figure 5:
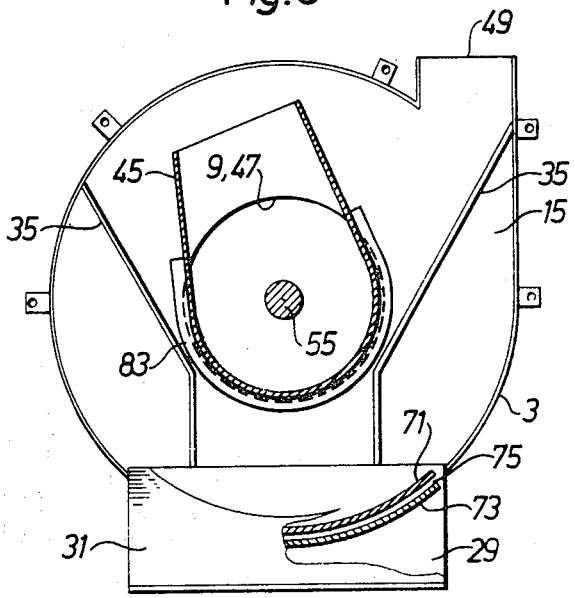
FIG. 5 is a cross section taken between the fan housing and the chipper rotor housing and seen towards the fan housing.
Figure 6:
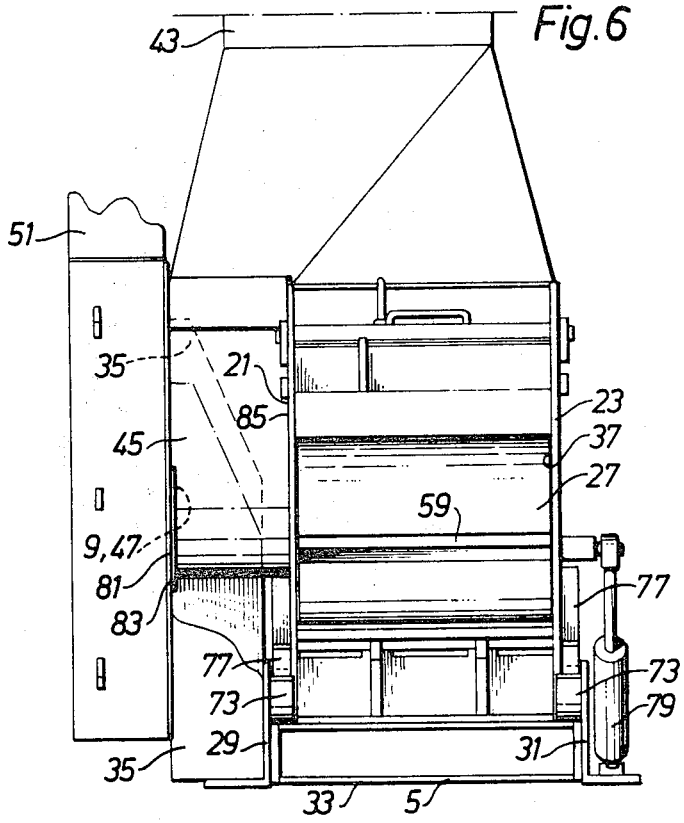
FIG. 6 is an enlarged elevation view of a part of the wood chipper in accordance with FIG. 3 and with certain components removed.

The side of the chipper rotor housing facing away from the inlet opening 37 is provided with an opening 111 that is adapted for receiving the cassette 93 and closed by the supporting plate 95 of the cassette as can be seen in FIG. 4. Suitable support devices 65 are arranged in the chipper rotor housing in order to maintain the cassette in the correct position. The cassette is locked in said position by means of suitable locking means 113.

The cassette described is easy to insert in and remove from the chipper rotor housing and can thereby be easily replaced by another cassette which has the same external appearance, but has a different distance between the ribs in order to produce a chips product having another desired maximum size of the chipped pieces. If desired, the arc-shaped edges may be formed with different radii for different cassettes in order to vary the distance from cylindrical surface of the chipper rotor so that the oversized pieces of material are assisted in by-passing the cassette. In that the wood chipper includes a set or system of replaceable cassettes optimum operating conditions can be rapidly attained by making simple tests with different cassettes to determine the correct cassette for a specific material which is to be chipped.

The supporting and guide means described for the pivotal journalling of the chipper rotor housing at the frame may of course be obtained in different ways and supplemented as desired. For example, the chipper rotor housing can be provided with pulleys or other roller devices which run in the support rails of the frame.

The outlet connection from the chipper rotor housing can be connected to the fan housing in other ways than those shown, i.e. at a distance from the axis of rotation of the fan housing. Even if a rigid outlet connection is presently preferred, outlet connections can be used which include flexible components or components shaped like toggle joints or telescopic tubes in order to absorb the motion which occurs during the pivoting of the chipper rotor housing.

The wood chipper in accordance with the invention can be supplemented with a three-point suspension, for instance, in order to be carried on the three-point lifter of a tractor or it can be attached to a special trailer or chassis in order to be coupled to a vehicle. In both cases a chips collecting vehicle can be connected in a suitable manner. The wood chipper can also be mounted stationarily in a chips production station.

The wood chipper in accordance with the invention can be used advantageously for all kinds of materials that may be considered for the production of chips. It can thus be fed with bushes, undergrowth, fuel wood, thinnings, pulp timber, logging waste from manual and mechanical logging, industrial and saw-mill waste such as edgings and sapwood, trimmings, joinery waste, etc.

What I claim is:

1. A wood chipper comprising a chipper rotor housing supported by a frame, and a chipper rotor rotatably journaled therein, said chipper rotor housing having inlet means for feeding material intended for chipping into the chipper rotor and outlet means for discharging wood chips produced by the chipper rotor, said chipper rotor housing and said frame including cooperating bearing means in the form of cooperating, arc-shaped support and guide means having radii that have a common center in the axis of rotation of the chipper rotor, the chipper rotor housing being, by means of said bearing means, pivotally arranged on the frame for pivoting around the axis of rotation of the chipper rotor and setting of said inlet means in different operating positions for adaptation to different operating conditions.

2. A wood chipper according to claim 1 wherein it further comprises a fan housing with inlet and outlet means, said fan housing being stationarily arranged in relation to the chipper rotor housing so that the fan housing and the outlet means thereof are free from the effect of a pivot movement of the chipper rotor housing.

3. A wood chipper according to claim 1 or 2 wherein the chipper rotor housing is arranged for limited pivot movement in order to be set in a first end position for substantially horizontal supply of the material into the chipper via an inlet opening and a second end position for supply from above of the material into the chipper, as well as in positions between said first and second end positions.

4. A wood chipper according to claim 2 wherein said outlet means of the chipper rotor housing comprises an outlet connection which connects the outlet opening of the chipper rotor housing to the inlet opening of the fan housing, said outlet connection forming a moveable unit together with the chipper rotor housing and being provided with an outlet end which encloses the inlet opening of the fan housing and is free from permanent connection to the fan housing in order to permit lateral displacement or pivot movement of said outlet end in relation to the fan housing during the pivot movement of the chipper rotor housing.

5. A wood chipper according to claim 4 wherein a fan wheel arranged in the fan housing has its axis of rotation mounted coaxially with the axis of rotation of the chipper rotor, said inlet opening of the fan housing being located at the axis of rotation of the fan wheel, the inlet opening enclosing the outlet end of the outlet connection being pivotally arranged in relation to the fan housing during the pivot movement of the chipper rotor housing.

6. A wood chipper according to claim 5 wherein the fan wheel and chipper rotor have a common axis of rotation.

7. A wood chipper according to claim 2 wherein the fan housing is rigidly mounted at the frame.

8. A wood chipper according to claim 7 wherein the separating device is arranged immovable before the outlet means.

9. A wood chipper according to claim 1 or 2 wherein it further includes a separating device arranged in the chipper rotor housing for permitting pieces of material up to the maximum desired size to pass therethrough and oversized pieces of material to be returned to a counter member at the inlet opening and cooperating with the chipper rotor.

10. A wood chipper according to claim 9 wherein the separating device comprises a supporting plate connectable to the chipper rotor housing, and a plurality of oblong, substantially parallel, uniform ribs attached to the supporting plate, said ribs forming between themselves substantially equally large spaces for said through passage of pieces of material of the desired maximum size, said spaces communicating with the outlet means.

11. A wood chipper according to claim 10 wherein each rib has a portion facing the chipper rotor with an arc-shaped edge having a radius with its centre substantially in the axis of rotation of the chipper rotor, said radius being somewhat larger than the radius of the chipper rotor so that a free passage is formed between each rib and the cylindrical surface of the chipper rotor in order to allow said oversized pieces of material to pass-by in order to be subjected to repeated chipping.

12. A wood chipper according to claim 10 wherein the separating device is arranged to be removably mounted as cassette-like unit in the chipper rotor housing which has an opening recloseable by said supporting plate.

13. A wood chipper according to claim 12 wherein the cassette is replaceable by an externally identical cassette which has a different number of ribs for the formation of substantially mutually equally large spaces between the ribs which deviate from those of said first cassette and are adapted to allow pieces of material of a different desired maximum size to pass therethrough.

14. A wood chipper according to claim 1 wherein said frame comprises two gable elements arranged at a distance from each other and provided on their inner surfaces facing each other with support means in the form of pairwise arranged support rails, said support rails of each pair form between themselves an arc-shaped interspace, the chipper rotor housing being provided with guide means in the form of two guide rails facing away from each other and arranged to be received in said interspace for slidable cooperation with the support rails of the frame.

15. A wood chipper according to claim 1 wherein it comprises a power transmission means for infinite pivoting of the chipper rotor housing.

16. A wood chipper according to claim 15 wherein said power transmission means comprises at least one double-acting hydraulic cylinder which is mounted between the frame and the chipper rotor housing at a distance from the axis of rotation of the chipper rotor.

17. A wood chipper comprising a chipper rotor housing supported by a frame, and a chipper rotor rotatably journaled therein, said chipper rotor housing having inlet means for feeding material intended for chipping into the chipper rotor and outlet means for discharging wood chips produced by the chipper rotor, said chipper rotor housing and said frame including cooperating bearing means, the chipper rotor housing being, by means of said bearing means, pivotally arranged on the frame for pivoting around the axis of rotation of the chipper rotor and setting of said inlet means in different operating positions for adaptation to different operating conditions, and a fan housing with inlet and outlet means, said fan housing being stationarily arranged in relation to the chipper rotor housing so that the fan housing and the outlet means thereof are free from the effect of a pivot movement of the chipper rotor housing.

* * * * *